US005402811A

United States Patent [19]

Weng

[11] Patent Number: 5,402,811

[45] Date of Patent: Apr. 4, 1995

[54] TELESCOPIC AND FOLDABLE CRUTCH STRUCTURE

[75] Inventor: Kuan-jen Weng, Tainan, Taiwan, Prov. of China

[73] Assignee: Keep-Young Industry Co., Ltd., Tainan, Taiwan, Prov. of China

[21] Appl. No.: 293,188

[22] Filed: Aug. 19, 1994

[51] Int. Cl.[6] ..... A61H 3/02

[52] U.S. Cl. ..... 135/68; 135/69; 135/72; 135/75

[58] Field of Search ..... 135/68, 69, 72, 74, 135/75, 76, 65, 73

[56] References Cited

U.S. PATENT DOCUMENTS

| | | | |
|---|---|---|---|
| 1,349,639 | 8/1920 | Taylor et al. | 135/68 |
| 4,476,885 | 10/1984 | Stein | 135/72 X |
| 4,637,414 | 1/1987 | Urban | 135/73 |
| 4,763,680 | 8/1988 | Acosta, Sr. | 135/74 X |
| 4,838,291 | 6/1989 | DiVito | 135/68 |
| 5,197,502 | 3/1993 | Wang | 135/68 X |
| 5,299,589 | 4/1994 | Zatulovsky | 135/68 |
| 5,351,701 | 10/1994 | Hsiao | 135/68 |

*Primary Examiner*—Lanna Mai

*Attorney, Agent, or Firm*—Browdy and Neimark

[57] ABSTRACT

A telescopic and foldable crutch structure includes an armpit seat, two telescopic inner tubes each having a top end on which the armpit seat is disposed, two telescopic outer tubes telescopically receiving the inner tubes, a handle adjustably coupling the telescopic inner and outer tubes with each other, a locking cam having a locking pin, two coupling blocks, two outer coupling tubes, an adjusting outer tube, an adjusting inner tube, a cap member fitted on bottom ends of the outer coupling tubes and the adjusting outer tube and a pad member fitted on a bottom end of the adjusting inner. The adjusting outer tube is tightened by the locking cam, The adjusting outer tube, is pivotally connected with the telescopic outer tubes by the locking pin and tightened between the telescopic outer tubes by the locking cam. The locking cam is adapted to be pulled upward, permitting the adjusting outer tube and the outer coupling tubes to be folded upward. The outer coupling tubes are coupled with the coupling blocks which are engaged with the bottom ends of the telescopic outer tubes via two latch springs. The handle is adapted to be rotated for uncoupling the telescopic inner tubes from the telescopic outer tubes for telescopically adjusting the length of the crutch.

1 Claim, 6 Drawing Sheets

TELESCOPIC AND FOLDABLE CRUTCH STRUCTURE

BACKGROUND OF THE INVENTION

The present invention relates to a telescopic and foldable crutch structure.

As shown in FIG. 1, a conventional crutch structure 1 is mainly composed of an armpit seat 11, two lateral tubes 12, a handle 13, a middle supporting tube 14, a cap member 15 fitted on a bottom end of the middle supporting tube 14, a telescopic tube 16 and a pad member 17.

The armpit seat 11 is disposed at top ends of the lateral tubes 12, including a sponge pad 111 for achieving a comfortable feeling. The lateral tubes 12 are symmetrically disposed and formed with multiple equally spaced through holes 121 for adjustably mounting the handle 13 therein by a butterfly nut 131, whereby the height of the handle 13 can be changed to meet the requirements of different users. The handle 13 is wrapped by a sponge body 132 for achieving a comfortable feeling.

The middle supporting tube 14 is disposed between lower sides of the lateral tubes 12 and formed with multiple equally spaced adjusting holes 141.

The telescopic tube 16 is telescopically inserted in the middle supporting tube 14. A top end of the telescopic tube 16 is formed with a through hole in which an elastic latching means 161 is disposed to engage with the adjusting holes 141 so as to adjust the extending length of the telescopic tube 16. The pad member 17 is fitted on a bottom end of the telescopic tube 16 to buffer the contacting force between the crutch 1 and the ground.

According to the above arrangements, the length of the lateral tubes 12 is fixed, while the height of the handle 13 and the length of the telescopic tube 16 as well as the length of the crutch 1 are adjustable to suit different users.

Several shortcomings are found to exist in the above conventional crutch structure as follows:

1. The length of the lateral tubes is fixed while the heights of different users vary about from 137 cm to 198 cm. Therefore, generally it is necessary to manufacture three specifications (L, M, S) of lateral tubes to meet the requirements of different users. Accordingly, it is necessary to prepare three different specifications of stocks for manufacturing the crutches. This complicates the stock preparation and the manufacturing operation of the crutches.

2. The telescopic tube is undetachably adjustably received in the middle supporting tube and the length adjustment of the telescopic tube is limited. On an situation that the crutch is not used such as the user sits in a car or a bus, it is inconvenient for the user to carry the crutch. Moreover, the length of the crutch necessitates considerably large amount of packing material and occupies great room when stored and transferred. All these increase the cost for the crutch.

3. The handle is adjustably mounted in the through holes of the lateral tubes by a butterfly nut. The butterfly nut protrudes outside the lateral tubes and tends to hook other articles or scrape the user's skin or even make the user fall down.

SUMMARY OF THE INVENTION

It is a primary object of the present invention to provide a telescopic and foldable crutch structure to eliminate the above shortcomings. The crutch structure of the present invention includes two telescopic outer tubes and two telescopic inner tubes which are telescopically adjustably received in and coupled with the telescopic outer tubes by a handle. Moreover, an adjusting inner tube is telescopically received in an adjusting outer tube. Therefore, the crutch structure is length-adjustable at different portions thereof so that one single crutch can meet various requirements of different users without preparing different specifications of crutch stocks.

It is a further object of the present invention to provide the above crutch structure in which the adjusting outer tube with two outer coupling tubes can be folded upward to greatly reduce the length of the crutch, so that the crutch can be easily carried and transferred and can be packed with reduced packing material so that the cost for packing and transferring is reduced.

It is still a further object of the present invention to provide the above crutch structure in which the handle is rotatably coupled between the telescopic inner and outer tubes in insertion manner without using any butterfly nut so that the adjustment can be easily performed and the appearance of the crutch is more tidy.

The present invention can be best understood through the following description and accompanying drawings, wherein:

DETAILED DESCRIPTION OF THE PREFERRED EMBODIMENT

Figures 1, 1A:
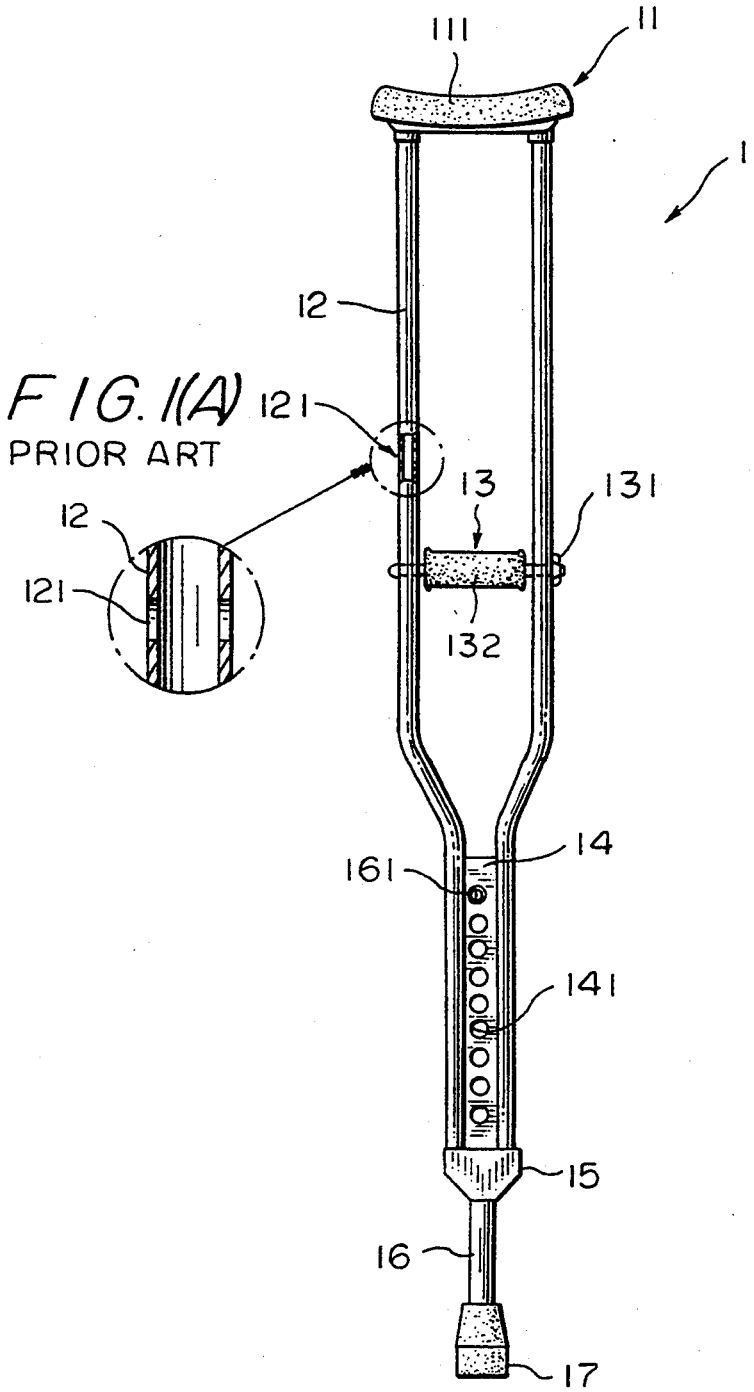
FIG. 1 PRIOR ART
FIG. 1(A) PRIOR ART
FIGS. 1, 1A are a front view and partially enlarged view of a conventional crutch structure.
Figure 2:
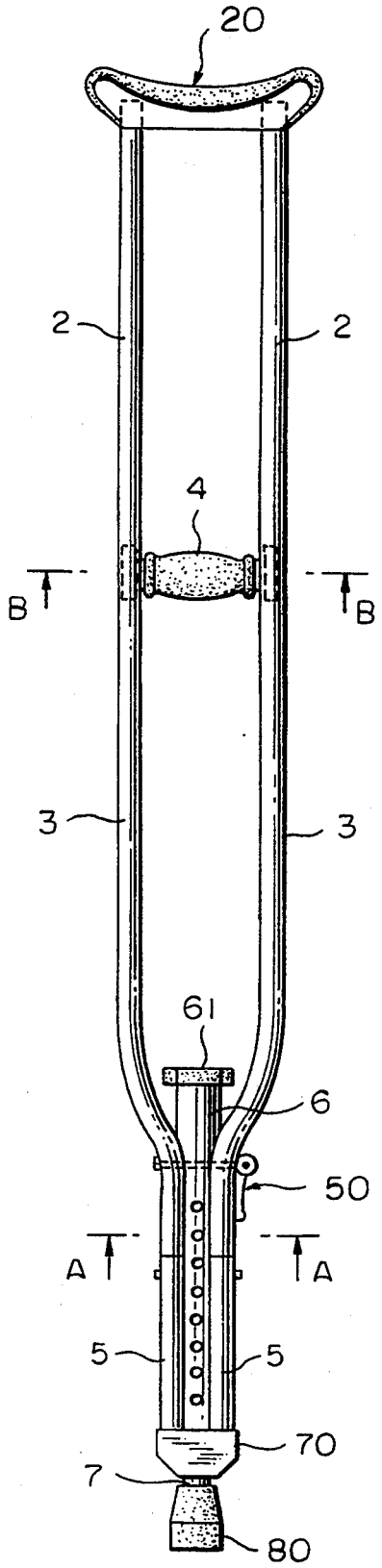
FIG. 2 is a front view of the present invention.
Figure 3:
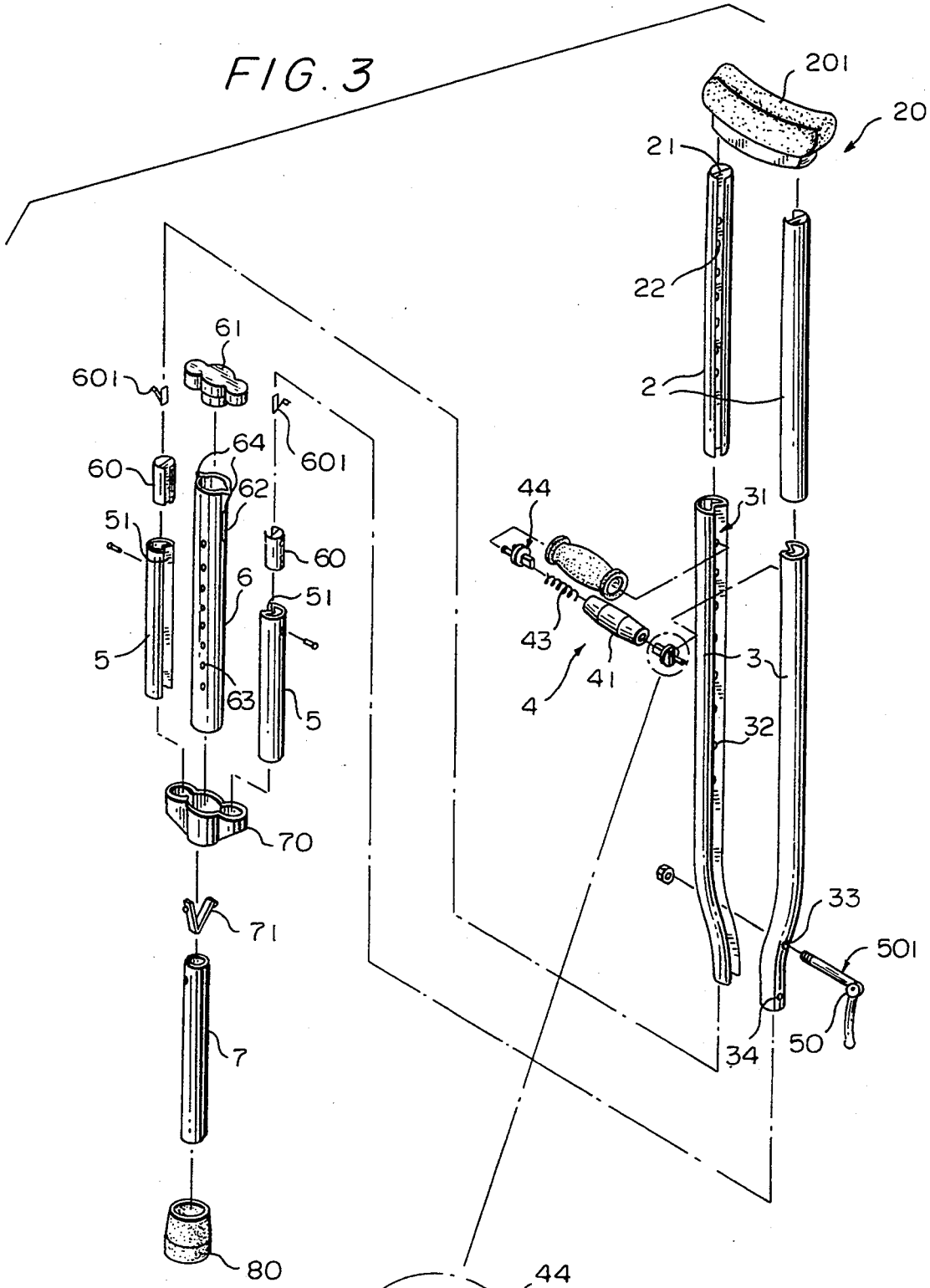
FIG. 3 is a perspective exploded view of the present invention.
Figure 3A:
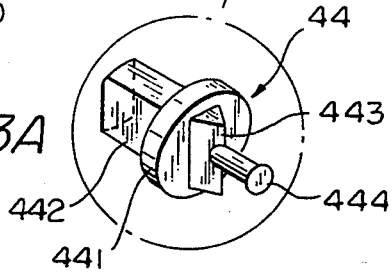
FIG. 3A is an enlarged view of the plug member of the handle.

Please refer to FIGS. 2, 3 and 3A. The crutch structure of the present invention mainly includes an armpit seat 20, two telescopic inner tubes 2, two telescopic outer tubes 3 telescopically receiving the inner tubes 2, a handle 4, a locking cam 50, two coupling blocks 60, two outer coupling tubes 5, an adjusting outer tube 6, an adjusting inner tube 7, a cap member 70 and a pad member 80.

The armpit seat 20 is wrapped by a sponge pad 201 and fixed at top ends of the telescopic inner tubes 2. The pad member 80 is fitted on a bottom end of the adjusting inner tube 7.

Each telescopic inner tube 2 has a substantially C-shaped cross-section and a lengthwise diaphragm 21 formed with multiple equally spaced through holes 22.

Each telescopic outer tube 3 has a lengthwise V-shaped channel 31 formed on an inner side thereof. The V-shaped channel 31 is formed with multiple locating holes 32 corresponding to the through holes 22 of the telescopic inner tube 2. A lower portion of the telescopic outer tube 3 is formed with a transverse through hole 33, whereby a locking pin 501 of the locking cam 50 is inserted through the through hole 33 of the telescopic outer tube 3 and a long elliptic slot 62 of the adjusting outer tube 6, so that the locking cam 50 can be used to tighten the adjusting outer tube 6. In addition, a bottom end of the telescopic outer tube 3 is formed with an insertion hole 34 for engaging with a latch spring 601 of the coupling block 60.

Figure 5:
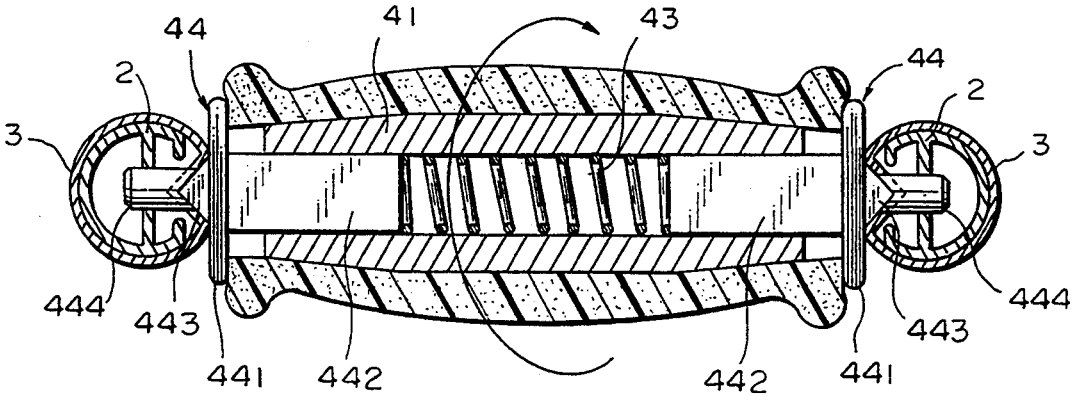
FIG. 5 is a sectional view showing that the handle is rotated through 90 degrees to retract the plug members and separate the locating pins thereof from the through holes of the telescopic inner tubes.
Figure 6:
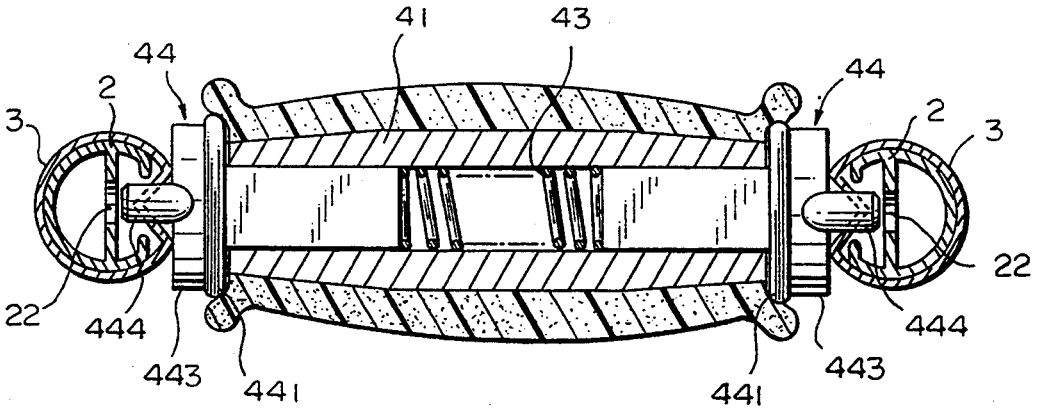
FIG. 6 is a view according to FIG. 5, wherein the locating pins are totally separated from the through holes of the telescopic inner tubes.

The handle 4 is composed of a hollow tube member 41, a sponge pad 42 wrapping the tube member 41, a compression spring 43 fitted in the tube member 41 and two plug members 44 plugged into two ends of the tube member 41. The compression spring 43 is disposed between the two plug members 44 to abut against the plug members 44, making the same protrude outside the tube member 41. The plug member 44 is integrally formed, having a disk portion 441, a plug portion 442 laterally extending from the disk portion 441 for inserting into the tube member 41, a triangular projecting block 443 laterally extending from the disk portion 441 opposite to the plug portion 442 to be received in the V-shaped channel 31 of the telescopic outer tube 3, and a locating pin 444 extending from a central section of the projecting block 443 to insert into the locating hole 32 of the telescopic outer tube 3 and the through hole 22 of the telescopic inner tube 2. Accordingly, the telescopic inner and outer tubes 2, 3 and the handle 4 are adjustably engaged with one another. When adjusted, referring to FIGS. 5 and 6, the handle 4 is rotated through 90 degrees, making the triangular projecting block 443 of the plug member 44 abut against a top edge of the V-shaped channel 32. At this time, the plug member 44 is forced to retract into the tube member 41 and compress the compression spring 43. Simultaneously, the locating pin 444 is inward retracted to separate from the through hole 22 of the telescopic inner tube 2, permitting the telescopic inner tube 2 to be telescoped within the telescopic outer tube 3 for height adjustment.

Figure 4:
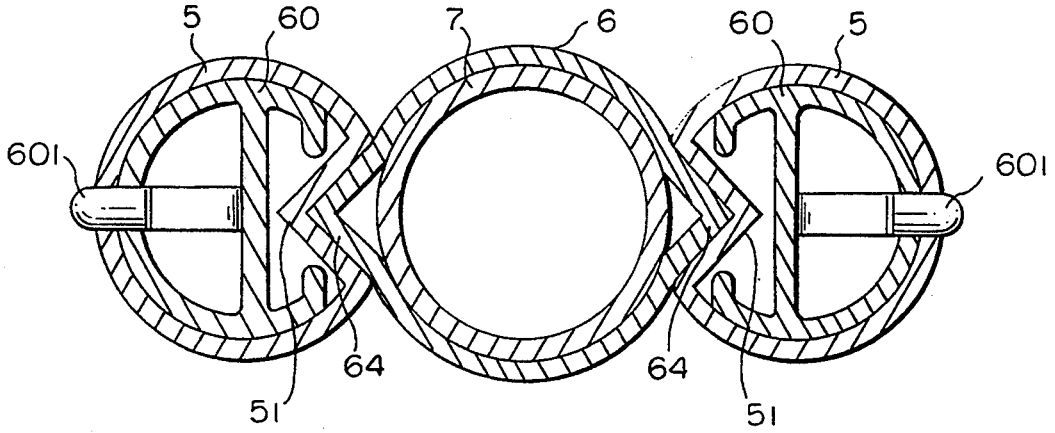
FIG. 4 is a sectional view taken along line A—A of FIG. 2.

Each outer coupling tube 5 has a lengthwise V-shaped channel 51 formed on an inner side thereof. The coupling block 60 is fixed at a top end of the outer coupling tube 5 and the latch spring 601 is disposed in the coupling block 60 to engage with the insertion hole 34 of the bottom end of the telescopic outer tube 3. Referring to FIG. 4, the adjusting outer tube 6 has a substantially circular cross-section and two lengthwise V-shaped projections 64 formed on two opposite sides thereof. The V-shaped projections 64 are snugly received in the V-shaped channels 31 of the telescopic outer tubes 3 and the V-shaped channels 51 of the outer coupling tubes 5. A protective cover 61 is fitted into a top end of the adjusting outer tube 6. As previously described, the adjusting outer tube 6 is formed with a long elliptic slot 62 for the locking pin 501 of the locking cam 50 to extend therethrough so that the locking cam 50 can tighten the adjusting outer tube 6. The adjusting outer tube 6 is formed with multiple equally spaced adjusting holes 63 for adjustably engaging with a latch spring 71 of the adjusting inner tube 7, whereby the adjusting inner tube 7 can be telescoped within the adjusting outer tube 6 for length adjustment.

According to the above arrangements, the telescopic inner and outer tubes 2, 3 are coupled with each other by the handle 4 and the adjusting outer tube 6 is pivotally connected with the telescopic outer tubes 3 by the locking pin 501 and tightened between the telescopic outer tubes 3 by the locking cam 50. The outer coupling tubes 5 are coupled with the coupling blocks 60 by screws and the coupling blocks 60 are engaged with the bottom ends of the telescopic outer tubes 3 via the latch springs 601, whereby the locking cam 50 is prevented from being incautiously touched and loosened to result in undesired folding of the crutch.

Figure 7:
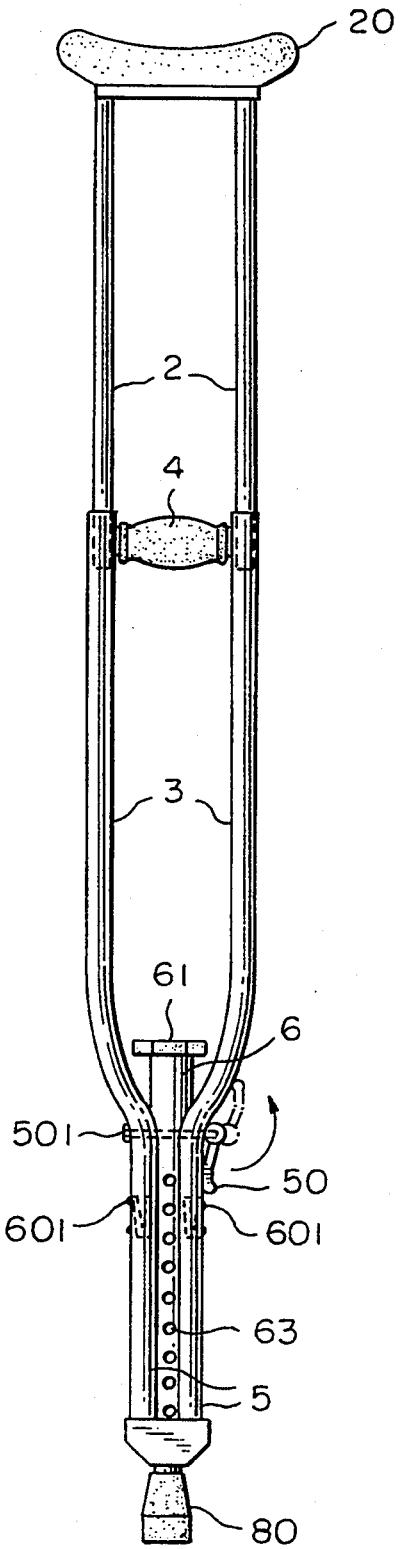
FIG. 7 is a view showing the unfolded crutch of the present invention.
Figure 8:
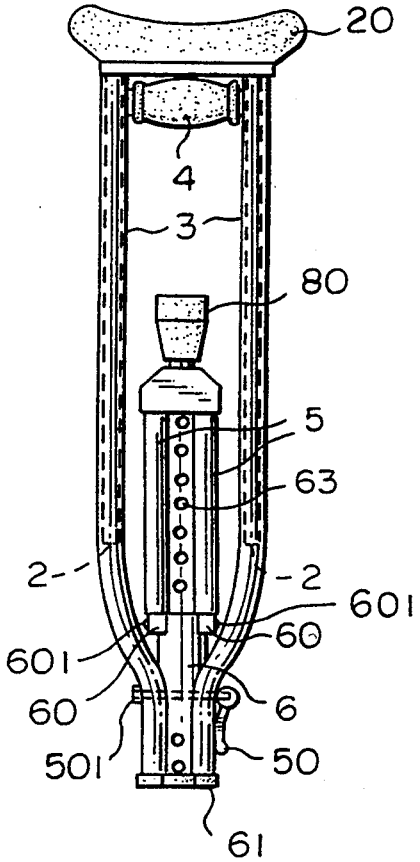
FIG. 8 is a view according to FIG. 7, showing that the crutch is folded.
Figure 9:
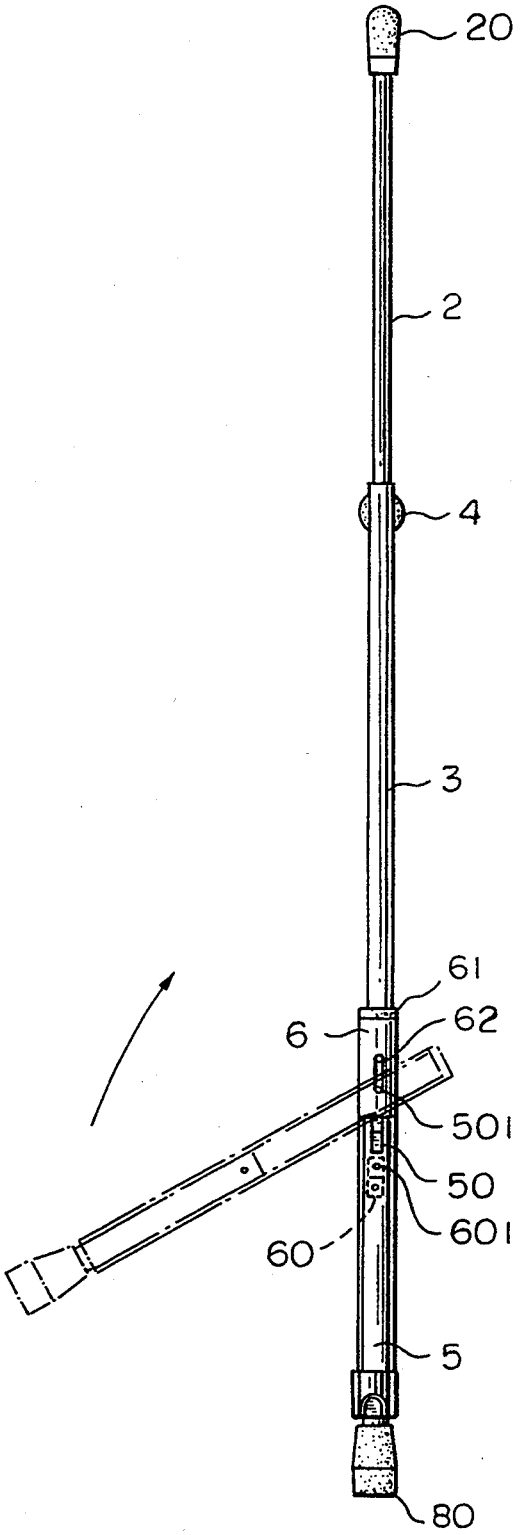
FIG. 9 is a side view showing that the crutch is to be folded.
Figure 10:
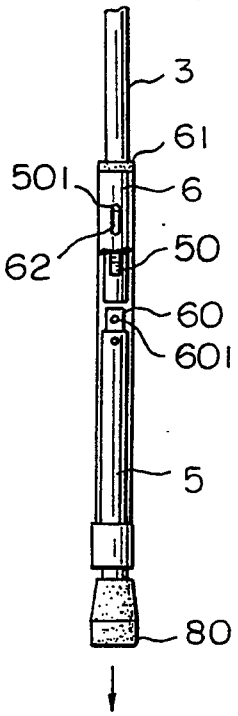
FIG. 10 is a view according to FIG. 9, showing that the adjusting outer tube is moved downward and the coupling blocks are separated from the telescopic outer tubes, permitting the crutch to be folded.

Please refer to FIGS. 7, 9 and 10. When it is desired to telescope and fold the crutch, the locking cam 50 is first pulled upward to loosen the adjusting outer tube 6 from the telescopic outer tubes 3. Meanwhile, the latch springs 601 of the coupling blocks 60 are pressed inward to separate the coupling blocks 60 from the telescopic outer tubes 3. At this time, the adjusting outer tube 6 is moved downward with the locking pin 501 relatively sliding along the slot 62 of the adjusting outer tube 6. Then, the adjusting outer tube 6 and the outer coupling tubes 5 can be pivoted upward about the locking pin 501. When it is desired to adjust the length of the crutch, referring to FIGS. 5 and 6, as previously described, the handle 4 is rotated through 90 degrees, making the triangular projecting block 443 of the plug member 44 abut against a top edge of the V-shaped channel 32. At this time, the plug member 44 is forced to retract into the tube member 41 and compress the compression spring 43. Simultaneously, the locating pin 444 is inward retracted to separate from the through hole 22 of the telescopic inner tube 2, permitting the telescopic inner tube 2 to be telescoped within the telescopic outer tube 3 for height adjustment. Moreover, the telescopic outer tubes 3 can be slightly biased outward from each other to separate the locating pins 444 from the locating holes 32 of the telescopic outer tubes 3. At this time, the locating pins 444 of the handle 4 can be moved to engage with other locating holes 32 to adjust the height of the handle 4.

The advantages of the present invention according to the above embodiment are as follows:

1. The crutch of the present invention is adjustable at multiple portions thereof so that one single crutch can meet various requirements of different users without preparing different specifications of crutch stocks.

2. The present crutch can be folded to have a half of the original length so that the carriage thereof is facilitated.

3. The folded crutch occupies reduced room and can be packed with reduced packing material so that the cost for packing and transferring is reduced.

4. The handle is coupled between the telescopic inner and outer tubes in insertion manner without using any butterfly nut so that the shortcoming that the butterfly nut may hook other articles or scrape the user's skin is eliminated. In addition, the appearance of the crutch becomes more tidy.

The above embodiment is only an example of the present invention and the scope of the present invention should not be limited to the example. Any modification or variation derived from the example should fall within the scope of the present invention.

What is claimed is:

1. A telescopic and foldable crutch structure comprising an armpit seat, two telescopic inner tubes each having a top end on which the armpit seat is disposed, two telescopic outer tubes telescopically receiving the inner tubes, a handle, a locking cam, two coupling blocks, two outer coupling tubes, an adjusting outer tube, an adjusting inner tube, a cap member fitted on bottom ends of the outer coupling tubes and the adjusting outer tube and a pad member fitted on a bottom end of the adjusting inner tube, said crutch structure being characterized in that:

each telescopic inner tube has a substantially C-shaped cross-section and a lengthwise diaphragm formed with multiple equally spaced through holes;

each telescopic outer tube has a lengthwise V-shaped channel formed on an inner side thereof, the V-shaped channel being formed with multiple locating holes corresponding to the through holes of the telescopic inner tube, a lower portion of the telescopic outer tube being formed with a transverse through hole, a bottom end of the telescopic outer tube being formed with an insertion hole;

the handle includes a hollow tube member, a compression spring fitted in the tube member and two plug members plugged into two ends of the tube member, said plug members compression spring being disposed between the two plug members to abut against the plug members, making said plug members protrude outside the tube member, the plug member being integrally formed, having a disk portion, a plug portion laterally extending from the disk portion for inserting into the tube member, a triangular protecting block laterally extending from the disk portion opposite to the plug portion to be received in the V-shaped channel of the telescopic outer tube and a locating pin extending from a central section of the projecting block to insert into the locating hole of the telescopic outer tube and the through hole of the telescopic inner tube;

each outer coupling tube has a lengthwise V-shaped channel formed on an inner side thereof, the coupling block being fixed at a top end of the outer coupling tube and a latch spring being disposed in the coupling block to engage with the insertion hole of the bottom end of the telescopic outer tube; and the adjusting outer tube has a substantially circular cross-section and two lengthwise V-shaped projections formed on two opposite sides thereof, a protective cover being fitted into a top end of the adjusting outer tube, the adjusting outer tube being formed with a long elliptic slot for a locking pin of the locking cam to extend therethrough, whereby the adjusting outer tube is tightened by the locking cam, the adjusting outer tube being formed with multiple equally spaced adjusting holes for adjustably engaging with a first latch spring of the adjusting inner tube, whereby the telescopic inner and outer tubes are coupled with each other by the handle and the adjusting outer tube is pivotally connected with the telescopic outer tubes by the locking pin and tightened between the telescopic outer tubes by the locking cam, the outer coupling tubes being coupled with the coupling blocks which are engaged with the bottom ends of the telescopic outer tubes via two second latch springs.

* * * * *